US006430912B2

(12) United States Patent
Lenz et al.

(10) Patent No.: US 6,430,912 B2
(45) Date of Patent: Aug. 13, 2002

(54) YARN FALSE TWIST TEXTURING APPARATUS

(75) Inventors: Friedhelm Lenz, Wuppertal; Hellmut Lorenz, Remscheid, both of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/771,768

(22) Filed: Jan. 29, 2001

Related U.S. Application Data

(63) Continuation of application No. PCT/EP00/04638, filed on May 22, 2000.

(30) Foreign Application Priority Data

May 27, 1999 (DE) ..... 199 24 282

(51) Int. Cl.[7] ..... D02G 1/00

(52) U.S. Cl. ..... 57/284; 57/282; 57/283; 57/287; 57/288; 57/289; 57/290; 57/291

(58) Field of Search ..... 57/282, 283, 284, 57/287, 288, 289, 290, 291; 28/247, 248, 249

(56) References Cited

U.S. PATENT DOCUMENTS

| | | | | | |
|---|---|---|---|---|---|
| 4,226,092 | A | * | 10/1980 | Luthi | 62/374 |
| 4,331,000 | A | * | 5/1982 | Luthi | 62/374 |
| 5,359,845 | A | * | 11/1994 | Gabalda et al. | 57/290 |
| 5,649,345 | A | * | 7/1997 | Menegatto | 28/249 |
| 5,671,519 | A | * | 9/1997 | Naylor | 28/249 |
| 6,041,586 | A | * | 3/2000 | Naylor et al. | 57/290 |
| 6,047,536 | A | * | 4/2000 | Naylor et al. | 57/290 |

FOREIGN PATENT DOCUMENTS

| | | | | |
|---|---|---|---|---|
| DE | 3121959 | A1 | | 1/1983 |
| EP | 0727514 | A1 | * | 8/1996 |
| EP | 0727514 | A1 | | 8/1996 |
| EP | 0744481 | A1 | | 11/1996 |
| EP | 0744481 | A1 | * | 11/1996 |
| EP | 0903431 | A3 | | 3/1999 |
| EP | 0903431 | A2 | | 3/1999 |
| EP | 0903431 | A3 | * | 3/1999 |
| FR | 2320999 | | | 3/1977 |
| FR | 2380363 | | * | 3/1977 |
| FR | 2380363 | | | 9/1978 |

* cited by examiner

*Primary Examiner*—Danny Worrell
*Assistant Examiner*—Shaun R Hurley
(74) *Attorney, Agent, or Firm*—Alston & Bird LLP

(57) ABSTRACT

A yarn false twist texturing apparatus having a plurality of side by side processing stations for texturing a plurality of thermoplastic yarns, wherein at each station a first feed system withdraws the yarn from a feed yarn package, and advances the yarn to a false twist zone composed of a heater and a cooling device, as well as a twisting unit. A second feed system withdraws the yarn from the false twist zone and advances it to a takeup device. The cooling device includes a cooling tube, with the yarn spiraling in contact with its outer surface. For an intensive cooling of the yarn according to the invention, the cooling tube is cooled from the inside with a coolant flow, which flows in a direction opposite to the direction of the advancing yarn.

16 Claims, 3 Drawing Sheets

YARN FALSE TWIST TEXTURING APPARATUS

CROSS REFERENCE TO RELATED APPLICATION

This is a continuation of international application No. PCT/EP00/04638, filed May 22, 2000, and designating the U.S.

BACKGROUND OF THE INVENTION

The present invention relates to a yarn false twist texturing apparatus or machine of the general type disclosed in DE 31 21 959.

Texturing is intended to impart to a substantially flat yarn a more textilelike appearance and the therewith connected characteristics. To this end, the flat yarn being fed to the texturing machine is twisted in the texturing machine by a twisting unit. Subsequently, this false twist is set in the yarn within a false twist texturing zone by heating the twisted yarn in a heating device. Subsequent to the heat treatment, the yarn must again be cooled by a cooling device. To this end, the yarn spirals in the known texturing machine around the outer surface of a cooling tube, which is cooled in its interior by a coolant. The spiral advance of the yarn achieves on the one hand a stable yarn path in the texturing zone and on the other hand an improved heat transfer between the yarn and the cooling device.

In texturing machines of this kind, it is currently common practice to use heating devices, which exhibit a heating temperature that is above the melt point of the yarn material. These so-called high-temperature heaters make it possible to keep the texturing zone relatively short despite the high yarn speeds of up to 1,200 m/min. Thus, besides the intensive heating of the yarn, it is necessary that an intensive cooling adapted to the heating of the yarn be effected in the cooling device.

In the texturing machine known from EP 0 744 481, it is proposed to subdivide the cooling device into two zones. In a first zone, a plurality of openings are arranged in the jacket of a cooling tube. It is thereby realized that the yarn advancing on the outer circumference of the cooling tube comes into direct contact with a coolant. However, this arrangement has the disadvantage that it causes an increased portion of volatile components to separate from the yarn, which can be taken in and removed only by an additional suction device. Furthermore, such a direct contact of the yarn with the coolant on the cooling tube leads to an unstable yarn advance even in the second zone, in which the yarn advances on the outer surface of the cooling tube.

It is therefore an object of the invention to further develop a texturing machine of the initially described type wherein a yarn can be intensively cooled as rapidly possible, even at high yarn speeds and a high temperature load in the heating device.

A further object of the invention is to provide a texturing machine with a cooling device, wherein a plurality of parallel arranged cooling tubes can be supplied in a simple manner by one source of coolant.

SUMMARY OF THE INVENTION

The above and other objects and advantages of the invention are achieved by the provision of a yarn false twist texturing apparatus which comprises a yarn heater, a yarn cooling device, and a yarn twisting unit serially arranged along a yarn path of travel. The yarn cooling device comprises a cooling tube which defines an upstream end adjacent the yarn heater and an opposite takeoff end, and the cooling tube is sized and positioned for having the advancing yarn spirally advance thereover from the upstream end to the takeoff end. A source of cooling fluid is arranged to flow through the interior of the cooling tube in a direction from the takeoff end to the upstream end so as to cool the cooling tube from the inside and cool the yarn as it advances along the cooling tube.

The special feature of the invention lies in that the cooling effect of the cooling tube is intensified toward the takeoff end. This prevents the yarn from undergoing a shocklike cooling, as it contacts the cooling tube. Since the coolant flowing from the takeoff end to the upstream end is already heated by the constant heat transfer between the outer surface and the coolant, the upstream end of the cooling tube is less cooled by the coolant than the takeoff end of the cooling tube. A further advantage lies in that upon leaving the cooling device, the yarn has a uniform temperature, since the outer surface of the cooling tube has in the takeoff end a temperature that is determined by the coolant supplied thereto. The coolant flowing opposite to the direction of the advancing yarn provides that the yarn guided on the outer surface contacts a surface, which becomes constantly cooler, and thus undergoes a more effective cooling, which has an especially favorable effect on the setting of the crimp in the yarn.

In the preferred embodiment, the takeoff end of the cooling tube is closed, and the yarn cooling device further includes an inner tube positioned coaxially within the cooling tube so as to define a passage which extends axially between the inner tube and the cooling tube. The inner tube has a discharge end adjacent the closed takeoff end of the cooling tube and an opposite inlet end adjacent the upstream end of the cooling tube, and the discharge end of the inner tube has at least one opening therein. The inlet end of the inner tube is connected to the source of cooling fluid, so that the cooling fluid flows through the inner tube and exits into the passage through the opening in the discharge end and then flows back through the passage toward the upstream end of the cooling tube. In this process, the outer surface of the cooling tube is cooled.

The upstream end of the cooling tube preferably forms an outlet which communicates with the passage and through which the coolant exhausts. With this configuration, all connections may be arranged at one end of the cooling device, i.e. the cooling device connects to the source of the coolant only at one end. The opposite end of the cooling device has no connections whatsoever, so that the length of the texturing zone is essentially dependent on the operative lengths of the heater and the cooling device.

The cooling passage extends along substantially the entire length and circumference of the outer cooling tube, which provides uniform cooling on the outer surface of the cooling tube.

It is also preferred that the inner tube have a free flow cross section, which is greater than that of the cooling passage. This results in the heat being quickly removed from the cooling tube, and the outer surface undergoes in addition an intensive cooling.

Preferably, the free flow cross section of the inner tube is made at least twice as large as the free flow cross section of the cooling passage.

In a particularly preferred embodiment of the texturing machine, the coolant used is a cooling air. In this instance, the source of coolant includes a blower. Since the coolant has a temperature ranging from 10° to 40° C., it is preferred in such case to make direct use of the ambient air as the coolant. The cooling device distinguishes itself in this case by its simple and yet effective construction.

In cases where the texturing machine is operated in a surrounding with higher air temperatures, it is desirable to construct the texturing machine to include an air-conditioning system which is directly used as the source of coolant and is connected to the cooling device.

With the use of a cooling air, it is preferred to arrange the cooling device of the texturing machine in an open coolant circuit. To this end, the texturing machine of the present invention is designed and constructed so that the heated cooling air is released directly to the surroundings via the outlet opening of the cooling tube.

To change the contact length and, thus, the intensity of the heat transfer between the yarn and the outer surface of the cooling tube, it is preferred to provide each cooling tube of the texturing machine of the present invention with an inlet yarn guide and an outlet yarn guide. By adjusting the inlet yarn guide or the outlet yarn guide in a circumferential direction, it is possible increase or decrease the looping about the cooling tube. To intensify of the cooling, the looping of the yarn about the cooling tube is increased. With that, the contact pressure of the yarn is increased, so that a more intensive cooling of the yarn occurs. This further development makes it thus possible to realize a fine adjustment of the yarn temperature at the takeoff end.

To obtain a uniformly satisfactory crimp quality, the cooling device extends with the yarn heater and the first feed system in a common plane upstream of the twisting unit. This prevents the yarn from undergoing in the twist zone an additional deflection, which impedes a return of the false twist in the yarn to the heater.

With the use of a plurality of parallel side by side cooling devices, it is possible to supply at the same time a plurality of cooling devices arranged side by side by one source of coolant. To this end, a collection tank or manifold is arranged between each cooling device and the source of coolant. From the manifold, the coolant reaches under the same pressure the cooling devices connected to the manifold. This system is therefore especially preferred for use in an open coolant circuit.

BRIEF DESCRIPTION OF THE DRAWINGS

The following drawings illustrate several embodiments of the invention, in which.

DETAILED DESCRIPTION OF THE PREFERRED EMBODIMENTS

Figure 1:
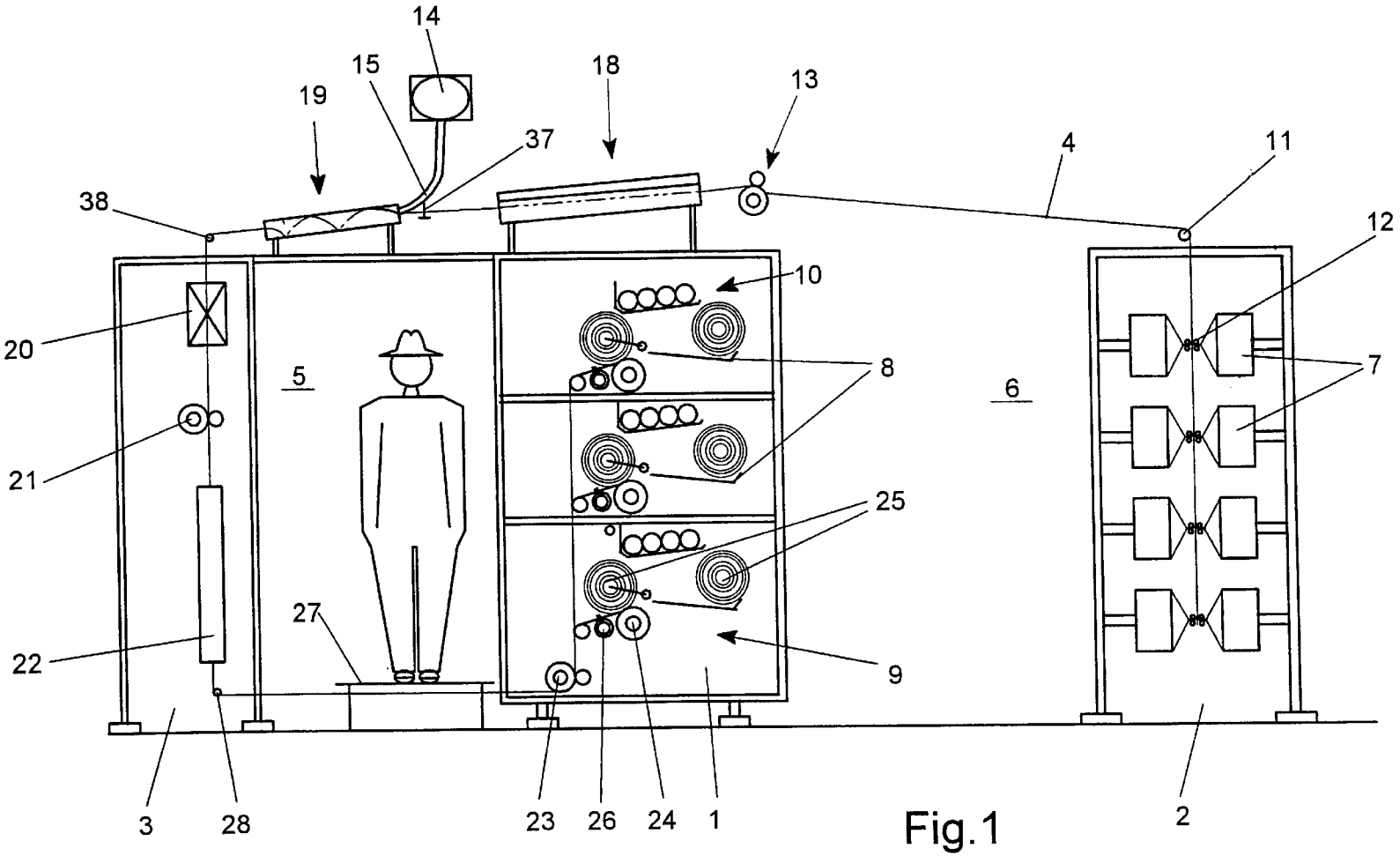
FIG. 1 is a schematic side elevation view of a texturing machine which embodies the present invention.

FIG. 1 is a schematic view of a texturing machine of the present invention. The texturing machine comprises a creel frame 2 for supporting a plurality of yarn feed packages 7, a process frame 3, and a takeup frame 1.

Between the process frame 3 and the takeup frame 1, an operator aisle 5 is formed. On the side of the takeup frame 1 opposite to the operator aisle, the creel frame 2 is arranged at a distance from the takeup frame 1. Thus, a doffing aisle 6 is formed between the takeup frame 1 and the creel frame 2.

In its longitudinal direction (in FIG. 1 the plane of the drawing corresponds to the transverse plane) the texturing machine comprises a plurality of side by side processing stations, each for one yarn. The takeup devices occupy a width of three processing stations. For this reason, as will be described further below, three takeup devices 9 overlie one another in a column in the takeup frame 1. Each processing station comprises a feed yarn package 7, on which a thermoplastic yarn 4 is wound. A first feed system 13 withdraws the yarn 4 under a certain tension via a yarn guide 12 and a deflection roll 11. In the embodiment of FIG. 1, the yarn advances between the creel frame 2 and the feed system 13 without a conduit. However, it is also possible to use conduits.

In the direction of the advancing yarn, downstream of the first feed system 13, a heater 18 extends, through which the yarn 4 advances and, in so doing, it is heated to a certain temperature. The heater is constructed as a high-temperature heater, in which the temperature of the heating surface is above 300° C. Such a heater is known, for example, from EP 0 412 429. To this extent, the publication is herewith incorporated by reference. Downstream of the heater 18 is a cooling device 19. The feed system 13, heater 18, and cooling device 19 extend one after another in a common, generally horizontal plane, so that a substantially straight-line yarn path results.

The cooling device 19 comprises an outer cooling tube 31, around whose outer surface the yarn 4 advances in a spiral manner. This cooling tube 31, which is described further below, connects via a line 15 to a source of coolant 14. The source of coolant 14 delivers a coolant into the interior of the cooling tube 31, so that the outer surface of the cooling tube 31 is continuously cooled.

In the yarn path upstream of the cooling device 19, an inlet yarn guide 37 is provided, and in the yarn path downstream of the cooling device an outlet yarn guide 38 is provided. Preferably, the inlet yarn guide or the outlet yarn guide is adjustable transversely to the direction of the advancing yarn, for purposes of changing the contact point of the yarn on the outer surface of the cooling tube 31 or the takeoff point of the yarn from the cooling tube 31, so that the yarn advances along the cooling tube 31 with more or less loopings.

Downstream of the cooling device 19 is a twisting unit 20. This twisting unit 20 may be designed and constructed, for example, as a conventional friction unit with rotating friction disks arranged on three shafts. In such a unit, the yarn advances through a cusp formed by the friction disks, and undergoes a twisting therein.

Downstream of the twisting unit 20, a second feed system 21 is used for drawing the yarn 4 both through the heater 18 and over the cooling device 19.

In the case that an aftertreatment of the textured yarn is necessary, the texturing machine comprises a set heater 22 in the direction of the advancing yarn downstream of the second feed system 21. This set heater 22 may be designed and constructed as a curved heating tube, which is surrounded by a heating jacket. In this heater, the heating tube is heated from the outside with vapor to a certain temperature. The set heater 22 could also be constructed as a high-temperature heater in the same way as the first heater.

Downstream of the second heater 22 is a yarn guide 28 and a further, third feed system 23. Upstream or downstream thereof is a lubrication device (not shown), which lubricates the yarn 4 before its entry into a takeup device 9. In the takeup device 9, the yarn is wound to a package 25, which driven on its circumference by a friction roll 24. Upstream of the friction roll 24 is a yarn traversing device 26, which reciprocates the yarn 4 along the package 25 and winds it on same in a cross wind.

As indicated above, an operator aisle 5 is formed between the process frame 3 and the takeup frame 1. In this arrangement, the yarn 4 advances across the operator aisle 5 below a platform 27. Above the operator aisle 5, the cooling device 19 is arranged, which is essentially supported on the process frame 3. Corresponding to the yarn path, the process frame accommodates the twisting unit 20, the second feed system 21, and the set heater 22.

In its upper region on the side facing away from the operator aisle, the takeup frame 1 supports the first feed system 13 directly upstream of the inlet to the heater 18. The heater 18 is also supported on the takeup frame 1. Corresponding to the yarn path, the lower end of the takeup frame 1 mounts the third feed system 23 in the takeup frame 1. Moreover, the takeup frame 1 accommodates the takeup devices 9.

Each takeup device 9 includes a package storage device 8 for receiving the full package, after a full package 25 has been produced in the takeup device. To remove the full package 25, a spindle carrier is pivoted, and the full package is deposited on a rollway. The rollway forms a part of the package storage device 8. On the rollway, the full package 25 awaits its removal. For this reason, the rollway of the package storage device 8 is arranged on the side of the takeup frame 1 adjacent the doffing aisle 6 and facing away from the operator aisle 5. Furthermore, each takeup device 9 is associated with a tube feeding device 10, which is not described in greater detail.

In the illustrated machine, the first feed system 13 withdraws the yarn 4 from a feed yarn package 7, and advances it into a twisting zone. The twisting zone consists of the heater 18, the cooling device 19, and the twisting unit 20. Within the twisting zone, the yarn undergoes a drawing and setting. The second feed system 21 withdraws the yarn 4 from the twisting zone, and subsequently advances it with the aid of a third feed system 23, under shrinkage condition, through a set heater 22. Downstream of the third feed system 23, the yarn 4 is advanced to the takeup device 9 and wound to a package 25.

Figure 2:
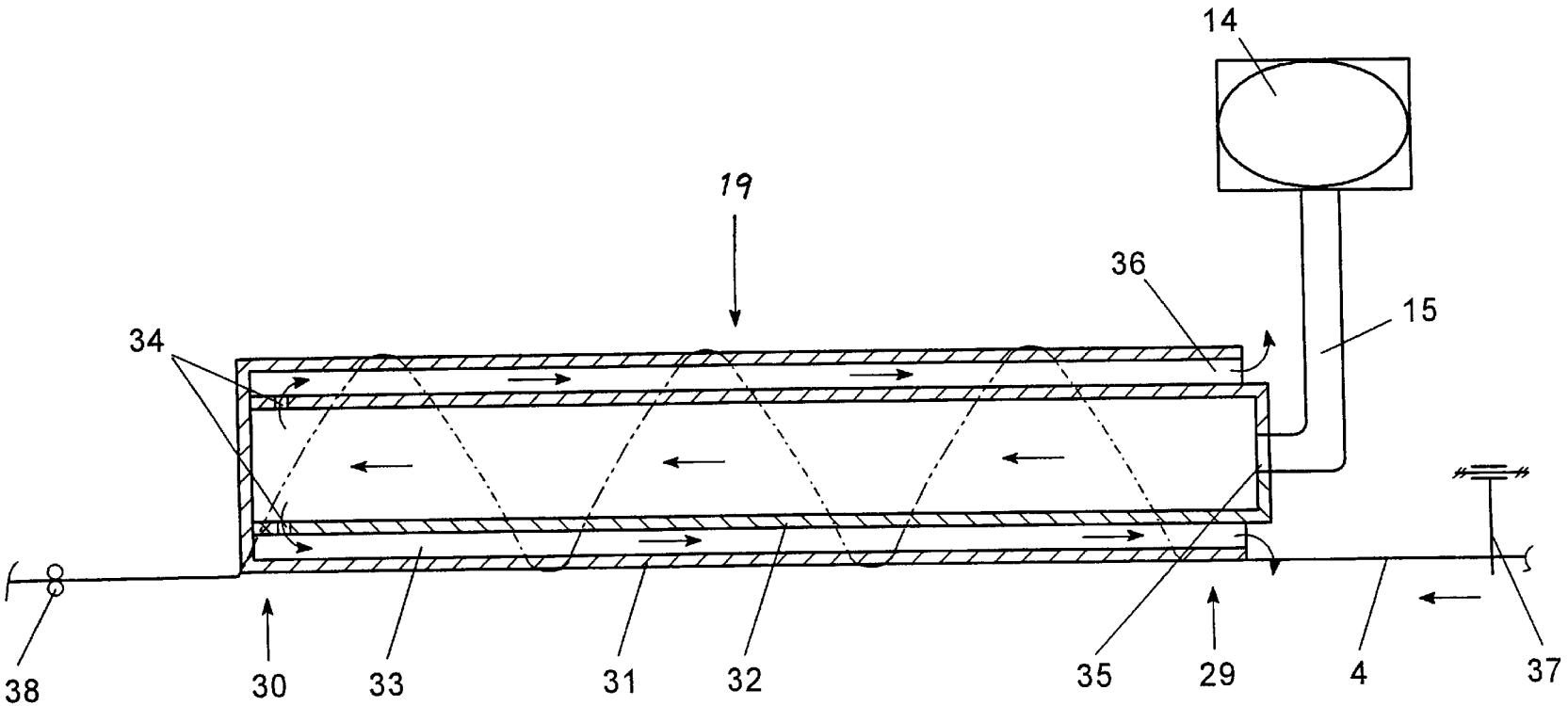
FIG. 2 is a schematic cross sectional view of a cooling device of the texturing machine of FIG. 1.

FIG. 2 is a schematic view of the cooling device 19, as is used in the texturing machine of FIG. 1. The cooling device 19 comprises an outer cooling tube 31, which has an upstream end 29 and a downstream or takeoff end 30. The yarn 4 advances onto the cooling tube 31 at its upstream end 29, and spirally loops about the outer surface of the cooling tube 31. At the takeoff end 30, the yarn 4 leaves the surface of the cooling tube 31, and continues to advance to the twisting unit 20. An inlet yarn guide 37 is arranged upstream of the upstream end 29. The inlet yarn guide 37 is designed and constructed for pivotal movement in the circumferential direction of the cooling tube and thus crosswise to the direction of the advancing yarn. At the opposite end of the cooling tube 31, an outlet yarn guide 38 is provided, which is likewise adapted for pivoting crosswise to the direction of the advancing yarn. By adjusting the inlet yarn guide and/or outlet yarn guide, it is possible to change the yarn looping about the cooling tube, for example, to obtain a more intensive cooling.

The cooling device 19 also includes an inner tube 32 positioned coaxially within the outer cooling tube 31 so as to define a passage 33 which extends axially between the inner tube 32 and the outer cooling tube 31. The inner tube has a discharge end adjacent the takeoff end 30 of the cooling tube 31, and an opposite inlet end adjacent the upstream end 29 of the cooling tube 31.

The passage 33 thus extends from the takeoff end 30 to the upstream end 29 of the outer cooling tube. The outer cooling tube 31 is closed at the takeoff end 30, and the closed end mounts the discharge end of the inner tube 32. The opposite inlet end of the inner tube 32 is provided with an inlet opening 35. This inlet opening 35 connects the inner tube 32, via a line 15, to a source of coolant 14. In the region of its discharge end, the inner tube 32 includes a plurality of radial openings 34. The openings 34 connect the interior space of the inner tube 32 to the passage 33.

At its upstream end 29, the outer cooling tube 31 is open and forms an outlet 36.

In the embodiment of the cooling device as shown in FIG. 2, the source of coolant 14 is designed and constructed as a blower. The blower 14 delivers a cooling air flow through the line 15 and into the interior of the inner tube 32. After passing axially along the length of the inner tube 32, the cooling air enters the passage 33 through the openings 34. In the passage 33, the cooling air flows opposite to the direction of the advancing yarn from the takeoff end 30 of the cooling tube to the upstream end 29 thereof, where the cooling air is discharged, via the outlet 36, into the surroundings. To obtain in the passage 33 a highest possible flow velocity opposite to the direction of the advancing yarn, the free flow cross section of the passage 33 is made smaller than the free flow cross section of the inner tube 32.

The embodiment of the cooling device 19 as shown in FIG. 2, is designed and constructed as an open coolant circuit. However, it is also possible to collect the warm exhaust air and discharge it to the outside, or to construct the cooling device with a closed coolant circuit. To this end, the outlet 36 connects, for example, to a coolant preparation system. From the coolant preparation system, it is possible to deliver the regenerated coolant again directly from the source of coolant 14 into the inner tube 32. In such an arrangement, is its also possible to use liquid coolants without difficulty. In the case that warm exhaust air is discharged, the outlet 36 will connect, for example, to a collection tube. Through the collection tube, the exhaust air is then guided outside of the air-conditioned room.

Figure 3:
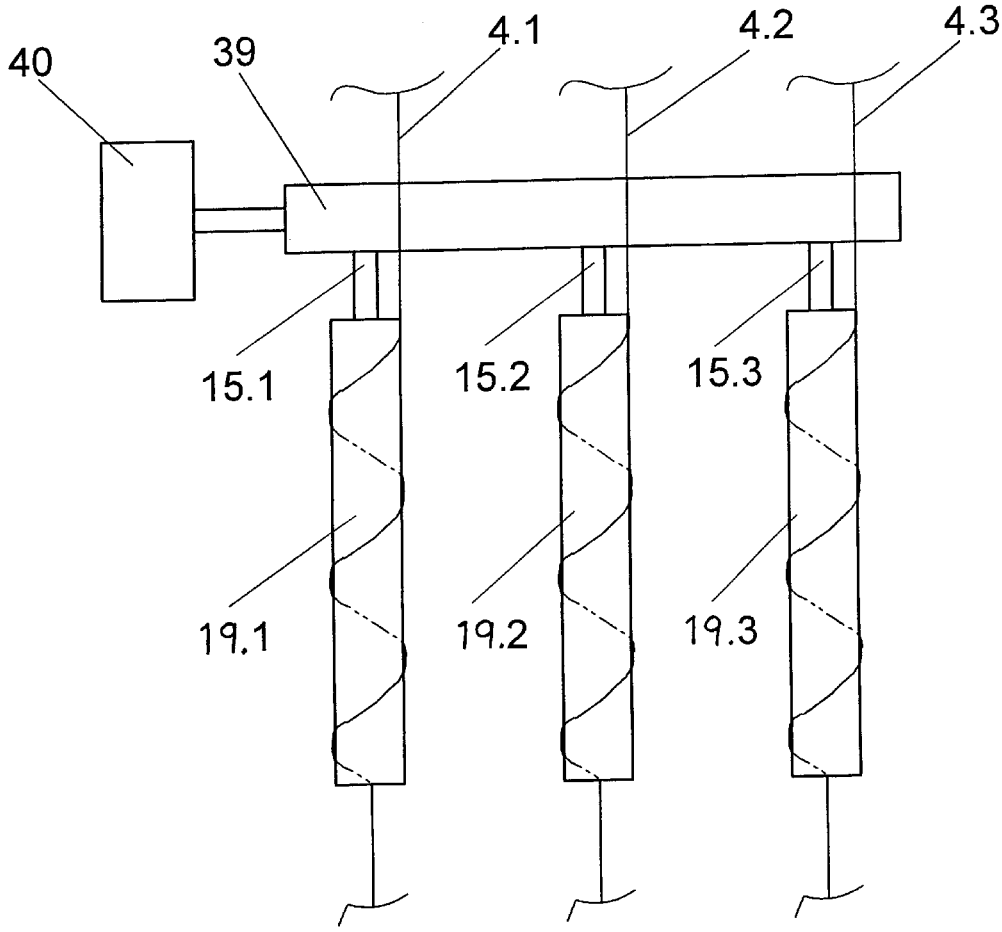
FIG. 3 shows a fragmentary view of three side by side cooling devices which are supplied from a common cooling fluid source.

FIG. 3 illustrates a further embodiment of a cooling device, as could be used, for example, in the texturing machine of FIG. 1. This embodiment illustrates the yarn path in three adjacent processing stations of a texturing machine. The yarns 4.1, 4.2, and 4.3 advance parallel to each other over the outer cooling tubes of three parallel, side by side cooling devices 19.1, 19.2, and 19.3, which connect via the lines 15.1, 15.2, and 15.3 to a common manifold 39. The manifold 39 connects to an air-conditioning system 40.

In this arrangement, cooling air that is introduced from the air-conditioning system 40 into the manifold 39, flows through the lines 15.1, 15.2, 15.3 to the individual cooling devices 19.1, 19.2, 19.3. To this end, the cooling devices may be formed, as previously described with reference to FIG. 2, by an outer cooling tube and an inner tube, so that the heated cooling air can subsequently be discharged into the surroundings.

In the texturing machine of the present invention, it is thus ensured that after leaving the heater, in particular a high-temperature heater, the yarn can be intensively cooled, without a strong, shocklike cooling occurring upon its entry into the cooling device.

A further advantage lies in a very compact twisting zone, since each cooling device is able to be connected to a source of coolant at one end only.

What is claimed is:

1. A yarn false twist texturing apparatus comprising a yarn heater, a yarn cooling device, and a yarn twisting unit serially arranged along a yarn path of travel, said yarn cooling device comprising a cooling tube which defines an upstream end adjacent the yarn heater and an opposite takeoff end, with the cooling tube being configured and positioned for having the advancing yarn spirally advance thereover from the upstream end to the takeoff end, and with said takeoff end of said cooling tube being closed, and wherein said yarn cooling device further comprises an inner tube positioned within the cooling tube so as to define a passage which extends between the inner tube and the cooling tube, with the inner tube having a discharge end with at least one opening therein which is located adjacent the closed takeoff end of the cooling tube and an opposite inlet end adjacent the upstream end of the cooling tube, and a source of cooling fluid connected with the inlet end of the inner tube so that the cooling fluid flows into the inlet end of the inner tube, through the inner tube, into the passage through the at least one opening in the discharge end of the inner tube, and then back through the passage toward the upstream end of the cooling tube so as to cool the cooling tube and cool the yarn as it advances along the cooling tube.

2. The yarn false twist texturing apparatus as defined in claim 1 wherein the upstream end of the cooling tube has an outlet which communicates with the passage and through which the cooling fluid exhausts.

3. The yarn false twist texturing apparatus as defined in claim 2 wherein the inner tube has an interior free flow cross section which is greater than the free flow cross of the passage.

4. The yarn false twist texturing apparatus as defined in claim 2 wherein the inner tube has an interior free flow cross section which is at least twice as large as the free flow cross section of the passage.

5. The yarn false twist texturing apparatus as defined in claim 2 wherein the source of cooling fluid comprises a source of air and a blower.

6. The yarn false twist texturing apparatus as defined in claim 5 wherein the source of cooling fluid further comprising an air conditioning unit.

7. The yarn false twist texturing apparatus as defined in claim 2 further comprises an inlet yarn guide positioned in the yarn path of travel adjacent the upstream end of the cooling tube and an outlet yarn guide positioned in the yarn path of travel adjacent the takeoff end of the cooling tube.

8. The yarn false twist texturing apparatus as defined in claim 7 wherein at least one of said inlet yarn guide and said outlet yarn guide is adjustably mounted for movement in the circumferential direction of the cooling tube.

9. The yarn false twist texturing apparatus as defined in claim 2 wherein the yarn heater and the yarn cooling device are arranged in a common, generally horizontal plane.

10. The yarn false twist texturing apparatus as defined in claim 1 wherein the inner tube is coaxially disposed within the cooling tube.

11. A yarn false twist texturing apparatus comprising a plurality of side by side processing stations, with each processing station comprising a feed yarn package holder, a first yarn feed system, a yarn heater, a yarn cooling device, a yarn twisting unit, a second yarn feed device, and a yarn takeup device serially arranged along a yarn path of travel, each of said yarn cooling devices comprising a cooling tube which defines an upstream end adjacent the yarn heater and an opposite takeoff end, with the cooling tube being configured and positioned for having the advancing yarn spirally advance thereover from the upstream end to the takeoff end, and with said takeoff end of said cooling tube being closed, and wherein said yarn cooling device further comprises an inner tube positioned within the cooling tube so as to define a passage which extends between the inner tube and the cooling tube, with the inner tube having a discharge end with at least one opening therein which is located adjacent the closed takeoff end of the cooling tube and an opposite inlet end adjacent the upstream end of the cooling tube, and a source of cooling fluid connected with the inlet end of the inner tube of each yarn cooling device so that the cooling fluid flows into the inlet end of the inner tube, through the inner tube, into the passage through the at least one opening in the discharge end of the inner tube, and then back through the passage toward the upstream end of the cooling tube so as to cool the cooling tube and cool the yarn as it advances along the cooling tube.

12. The yarn false twist texturing apparatus as defined in claim 11 wherein the source of cooling fluid is connected via a common manifold to the inlet end of each of the inner tubes.

13. The yarn false twist texturing apparatus as defined in claim 12 wherein the upstream end of each cooling tube has an outlet which communicates with the passage and through which the cooling fluid exhausts.

14. The yarn false twist texturing apparatus as defined in claim 13 wherein the inner tube of each cooling tube has an interior free flow cross section which is greater than the free flow cross section of the passage.

15. The yarn false twist texturing apparatus as defined in claim 13 wherein the inner tube of each cooling device has an interior free flow cross section which is at least twice as large as the free flow cross section of the passage.

16. The yarn false twist texturing apparatus as defined in claim 11 wherein the inner tube is coaxially disposed within the cooling tube.

* * * * *

UNITED STATES PATENT AND TRADEMARK OFFICE

CERTIFICATE OF CORRECTION

PATENT NO. : 6,430,912 B2
DATED : August 13, 2002
INVENTOR(S) : Lenz et al.

It is certified that error appears in the above-identified patent and that said Letters Patent is hereby corrected as shown below:

Column 7,
Line 35, after “cross” insert -- section --;
Lines 45-46, “comprising” should read -- comprises --;
Line 48, “comprises” should read -- comprising --.

Column 8,
Line 46, “cooling tube” should read -- cooling device --.

Signed and Sealed this

Tenth Day of December, 2002

JAMES E. ROGAN
*Director of the United States Patent and Trademark Office*